US007723645B2

(12) United States Patent
Smith

(10) Patent No.: US 7,723,645 B2
(45) **Date of Patent: *May 25, 2010**

(54) SWITCHING DEVICE AND SYSTEM

(75) Inventor: Jerry Wayne Smith, Irvine, KY (US)

(73) Assignee: Lexmark International, Inc., Lexington, KY (US)

( * ) Notice: Subject to any disclaimer, the term of this patent is extended or adjusted under 35 U.S.C. 154(b) by 268 days.

This patent is subject to a terminal disclaimer.

(21) Appl. No.: 11/869,957

(22) Filed: Oct. 10, 2007

(65) Prior Publication Data

US 2008/0247777 A1 Oct. 9, 2008

Related U.S. Application Data

(63) Continuation of application No. 11/231,159, filed on Sep. 20, 2005, now Pat. No. 7,312,420.

(51) Int. Cl.
*H05B 1/00* (2006.01)
*G03G 15/20* (2006.01)

(52) U.S. Cl. ..... 219/216; 399/69; 399/335

(58) Field of Classification Search ..... 219/216, 219/486, 512, 201; 399/69, 335
See application file for complete search history.

(56) References Cited

U.S. PATENT DOCUMENTS

| | | | |
|---|---|---|---|
| 4,088,868 | A | 5/1978 | Zeuthen |
| 4,496,829 | A | 1/1985 | Black et al. |
| 4,778,980 | A | 10/1988 | Rathbun |
| 4,822,977 | A | 4/1989 | Leising et al. |
| 4,951,096 | A | 8/1990 | Derimiggio et al. |
| 5,019,682 | A | 5/1991 | Lee |
| 5,860,051 | A | 1/1999 | Goto et al. |
| 6,018,151 | A | 1/2000 | Hirst |
| 6,285,838 | B1 | 9/2001 | Able et al. |
| 6,608,977 | B2 | 8/2003 | Tamaoki |
| 6,801,729 | B2 | 10/2004 | Wada et al. |
| 2005/0163525 | A1 | 7/2005 | Watabe |

*Primary Examiner*—Tu B Hoang
*Assistant Examiner*—Vinod D Patel

(57) ABSTRACT

A heating assembly for a printing device includes a heating device configured to be energized or deenergized. A switching device includes a bimetallic element efficiently thermally coupled to the heating device and configured to deenergize the heating device in a defined period of time in the event of an over temperature condition.

18 Claims, 5 Drawing Sheets

SWITCHING DEVICE AND SYSTEM

CROSS-REFERENCE TO RELATED APPLICATIONS

This application is a continuation of U.S. application Ser. No. 11/231,159, filed Sep. 20, 2005.

STATEMENT REGARDING FEDERALLY SPONSORED RESEARCH OR DEVELOPMENT

None.

REFERENCE TO SEQUENTIAL LISTING, ETC.

None.

BACKGROUND

1. Technical Field

This disclosure relates to switching devices and, more particularly, to a switching device that reacts in response to over temperature conditions which may occur in a printer.

2. Description of the Related Art

Printing devices often include heating devices that apply thermal energy to the media being processed by the printing device to e.g., affix toner to the media (i.e., for laser printers) or dry ink applied to the media (i.e., for inkjet printers). Typically, the temperature of these heating devices is regulated through the use of a controller circuit that e.g., monitors the temperature of the heating device and regulates the amount of power provided to the heating device. Unfortunately, in the event of a failure of the controller circuit, an over temperature condition may occur.

SUMMARY

In a first exemplary embodiment, a heating assembly for a printing device includes a heating device configured to be energized or deenergized. A switching device includes a bimetallic element efficiently thermally coupled to the heating device and configured to deenergize the heating device in a defined period of time in the event of an over temperature condition.

One or more of the following features may be included. The switching device may include a surface that is in contact with a surface of the heating device. A connector may be positioned between the switching device and the heating device, such that the connector has a thermal conductivity of at least 1.0 watt per meter-Kelvin.

The heating device may be a ceramic resistive heating device. The heating device may be a metallic resistive heating device. The heating device may be an ink drying assembly configured for drying ink on media. The heating device may be a fusing device configured for bonding toner to media.

The switching device may be electrically coupled in parallel with the heating device. The switching device may be electrically coupled in series with the heating device. The switching device may be configured to assume the temperature of the heating device in less than or equal to about 10 seconds. The switching device may include a bimetallic element.

In a second exemplary embodiment, a bimetallic switching device for a heating device in a printer includes a bimetallic element configured to be coupled to the heating device. The bimetallic element is efficiently thermally coupled to the heating device and configured to deenergize the heating device in the event of an over temperature condition.

One or more of the following features may be included. The element may be configured to deenergize the heating device within a defined period of time of less than or equal to about 10 seconds. A connector may be positioned between the switching device and the heating device, such that the connector has a thermal conductivity of at least 1.0 watt per meter-Kelvin.

The heating device may be a ceramic resistive heating device. The heating device may be a metallic resistive heating device. The heating device may be an ink drying assembly configured for drying ink on media. The heating device may be a fusing device configured for bonding toner to media. The bimetallic element may be electrically coupled in parallel with the heating device. The bimetallic element may be electrically coupled in series with the heating device.

In a third exemplary embodiment, a switching device for a printer includes a resettable thermal element configured to be efficiently thermally coupled to a heating device. The thermal element is configured to: deenergize the heating device in a defined period of time in the event of an over-temperature condition; and to energize the heating device once the over-temperature condition is eliminated.

One or more of the following features may be included. The defined period of time may be less than or equal to about 10 seconds. The thermal element may be directly thermally coupled to the electric heating device. A connector may be positioned between the thermal element and the heating device, such that the connector has a thermal conductivity of at least 1.0 watt per meter-Kelvin.

The heating device may be a ceramic resistive heating device. The heating device may be a metallic resistive heating device. The heating device may be an ink drying assembly configured for drying ink on media. The heating device may be a fusing device configured for bonding toner to media. The thermal element may be electrically coupled in parallel with the heating device. The thermal element may be electrically coupled in series with the heating device.

The details of one or more implementations are set forth in the accompanying drawings and the description below. Other features and advantages will become apparent from the description, the drawings, and the claims.

DETAILED DESCRIPTION

Figure 1:
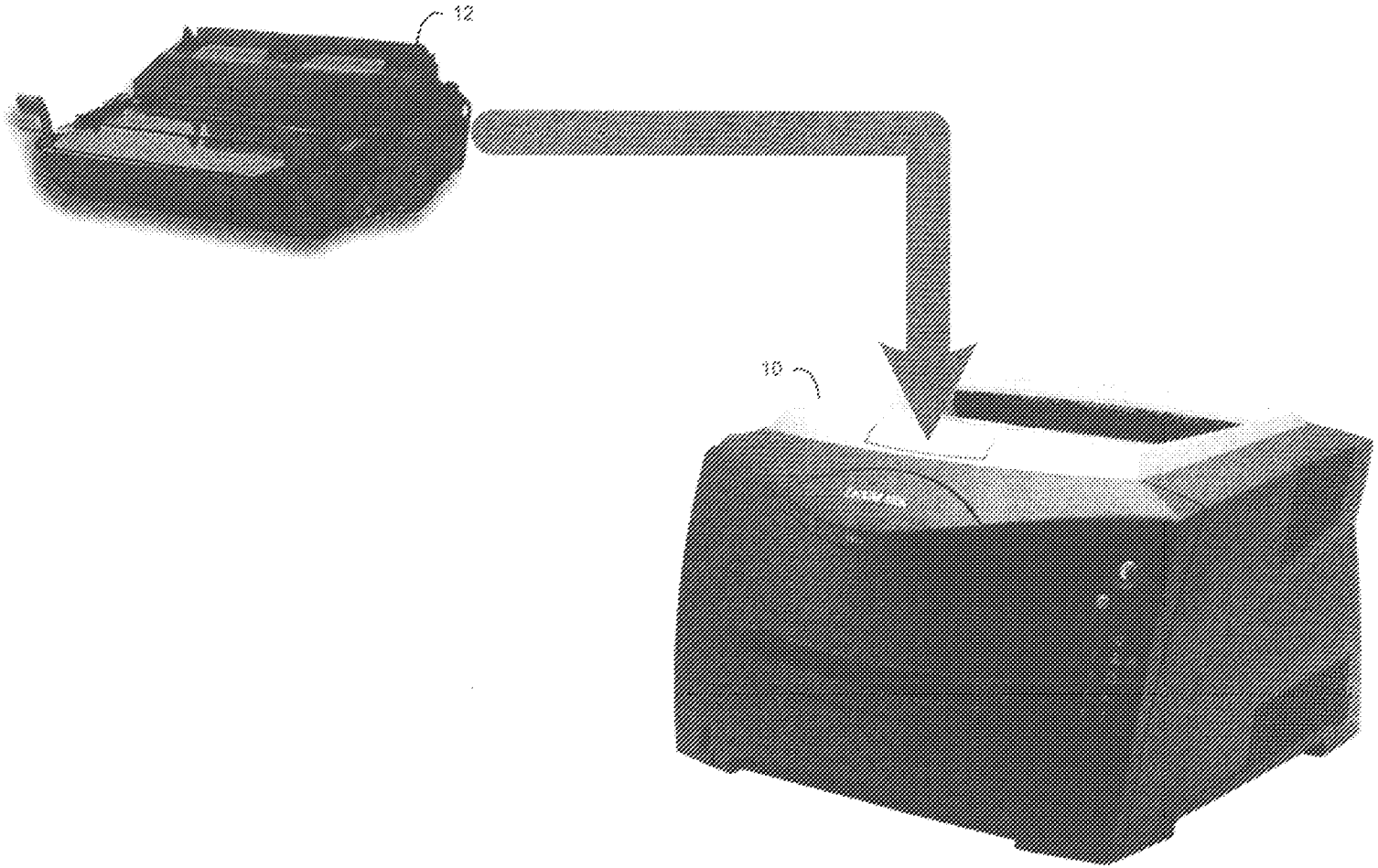
FIG. 1 is a diagrammatic view of an exemplary printing device and an exemplary printer cartridge for use within the printing device.

Referring to FIG. 1, there is shown an exemplary printing device 10 and an exemplary printer cartridge 12 for use within printing device 10. Printing device 10 may be coupled to a computing device (not shown) via e.g. a parallel printer cable (not shown), a universal serial bus cable (not shown), and/or a network cable (not shown). Printing devices herein may include, e.g., electrophotographic printers, ink-jet printers, dye sublimation printers, and thermal wax printers.

Exemplary printing device 10 is a device that accepts text and graphic information from a computing device and transfers the information to various forms of media (e.g., paper, cardstock, transparency sheets, etc.). Further a printer cartridge 12 is a component of exemplary printing device 10, which typically includes the consumables/wear components (e.g. toner and a drum assembly, for example) of printing device 10. Printer cartridge 12 typically also includes circuitry and electronics (not shown) required to e.g., charge the drum and control the operation of printer cartridge 12.

Figure 2:
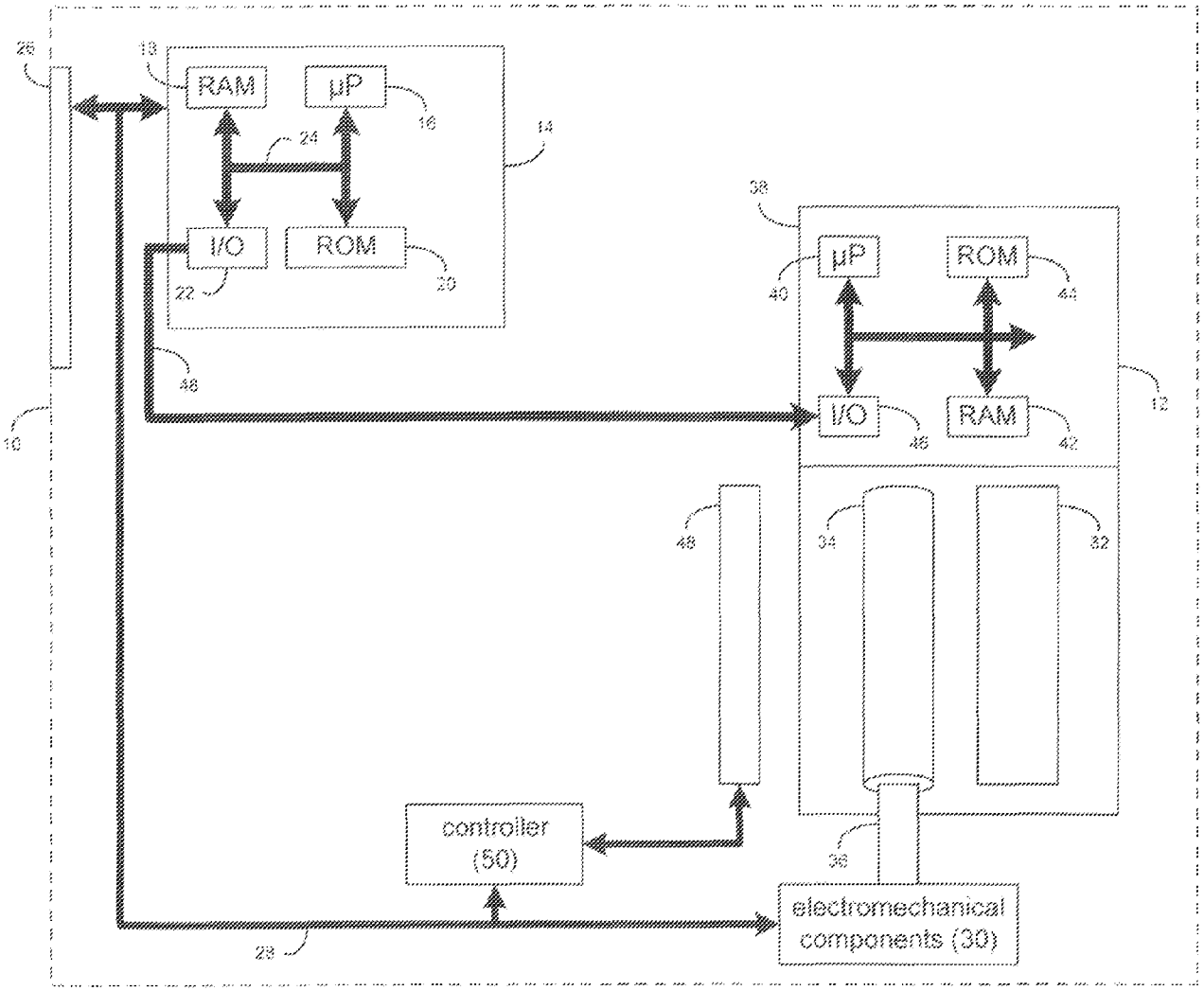
FIG. 2 is a diagrammatic view of the printing device of FIG. 1 interfaced to the printer cartridge of FIG. 1.

Referring also to FIG. 2, there is shown a diagrammatic view of an exemplary printer cartridge 12 interfaced with printing device 10. Typically, printing device 10 includes a system board 14 for controlling the operation of printing device 10. System board 14 may include a microprocessor 16, random access memory (i.e., RAM) 18, read only memory (i.e., ROM) 20, and an input/output (i.e., I/O) controller 22. Microprocessor 16, RAM 18, ROM 20, and I/O controller 22 may be coupled to each other via data bus 24. Examples of data bus 24 may include a PCI (i.e., Peripheral Component Interconnect) bus, an ISA (i.e., Industry Standard Architecture) bus, or a proprietary bus, for example.

Exemplary printing device 10 may include display panel 26 for providing information to a user (not shown). Display panel 26 may include e.g. an LCD (i.e. liquid crystal display) panel, one or more LEDs (i.e., light emitting diodes), and one or more switches. Display panel 26 may be coupled to I/O controller 22 of system board 14 via data bus 28. Examples of data bus 28 may include a PCI (i.e., Peripheral Component Interconnect) bus, an ISA (i.e., Industry Standard Architecture) bus, or a proprietary bus, for example. Printing device 10 may also include electromechanical components 30, such as: feed motors (not shown), gear drive assemblies (not shown), paper jam sensors (not shown), and paper feed guides (not shown), for example. Electromechanical components 30 may be coupled to system board 14 via data bus 28.

As discussed above, the exemplary printer cartridge 12 may include a reservoir for developing agent, such as a toner reservoir 32 and a toner drum assembly 34. The electromechanical components 30 may be mechanically coupled to printer cartridge 12 via a releasable gear assembly 36 that may allow the printer cartridge 12 to be removed from printing device 10. Developing agent may also include toner or ink and any other materials or compounds suitable to create an image on, e.g., a sheet of media.

Exemplary printer cartridge 12 may include a system board 38 that controls the operation of printer cartridge 12. System board 38 may include, e.g., microprocessor 40, RAM 42, ROM 44, and I/O controller 46. The system board 38 may be releasably coupled to system board 14 via data bus 48, thus allowing for the removal of exemplary printer cartridge 12 from printing device 10. Examples of data bus 48 may include a PCI (i.e., Peripheral Component Interconnect) bus, an ISA (i.e., Industry Standard Architecture) bus, an I2C (i.e., Inter-IC) bus, an SPI (i.e., Serial Peripheral Interconnect) bus, or a proprietary bus.

The exemplary printing device 10 may include a heating device such as a fusing device 48 for affixing the toner (supplied by toner reservoir 32 and applied by toner drum assembly 34) to the media being processed by printing device 10. As will be discussed below in greater detail, the fusing device may be a belt fuser. In addition, the temperature of the exemplary fusing device 48 may be controlled by controller 50. Controller 50 may be coupled to system board 14 via data bus 28. Alternatively, controller 50 may be incorporated into system board 14.

Figure 3:
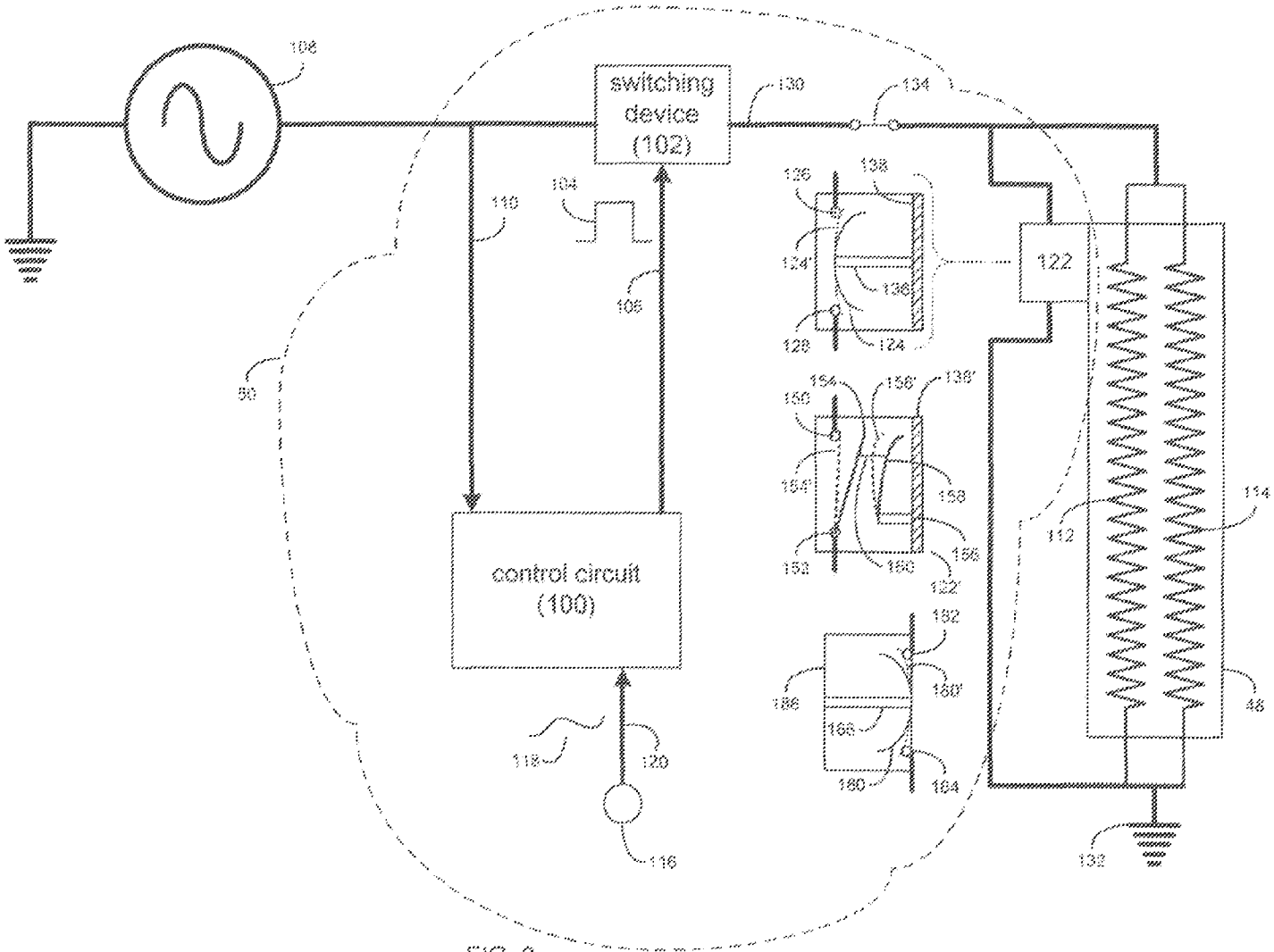
FIG. 3 is a diagrammatic view of the controller of FIG. 2, including a first exemplary implementation of a bimetallic switching device.

Referring also to FIG. 3, there is shown an exemplary diagrammatic view of controller 50 interfaced with the exemplary fusing device 48. Controller 50 may include a control circuit 100 and a switching device 102. Control circuit 100 may be configured to provide a gate pulse signal 104 to switching device 102 via conductor 106. Switching device 102 may be configured to control the power signal 108 applied to fusing device 48. Control circuit 100 may further be configured to monitor power signal 108 via conductor 110. Control signal 108 may be a 120 volt, 60 Hertz AC (i.e., alternating current) signal. Control circuit 100 may further be configured to monitor the temperature of the exemplary fusing device 48 using a temperature monitoring device 116 (e.g., a thermistor), such that temperature monitoring device 116 provides a temperature signal 118 to control circuit 100 via conductor 120. Conductors 106, 110, 120 may be e.g., foil-based conductors on a printer circuit board and/or wired-based conductors.

The exemplary fusing device 48 may include one or more discrete heating elements 112, 114 for converting electrical energy (from power signal 108) into thermal energy. Heating elements 112, 114 may be resistive heating elements (e.g., metallic or ceramic). Ceramic type may include aluminum oxide or aluminum nitride type materials onto which conductive and resistive lands may be printed, dried or fired in order to create a resistive heating element surface. During operation, power signal 108 is applied to the exemplary fusing device 48 via switching device 102. As noted above, fusing device 48 may therefore be a belt fuser, that employs a relatively thin belt wrapped over a ceramic or other relatively low-thermal capacity heater. The belt may be formed from polymeric type materials, such as polyimide type resins.

Temperature monitoring device 116 may monitor the temperature of the exemplary fusing device 48 and may generate temperature signal 118, which may be supplied to control circuit 100 via conductor 120. As discussed above, temperature monitoring device 116 may include a thermistor. A thermistor is typically a solid-state, temperature-dependant resistance device. Accordingly, by monitoring the resistance of temperature monitoring device 116, the temperature of the exemplary fusing device 48 may be determined by control circuit 100.

The desired temperature of the heating device in the printer may be based on several variables, such as the operating mode of printing device 10 and the type of developing agent being used in printing device 10. In an exemplary and non-limiting case of toner, such may include particles of pigment in combination with polymers that may be applied to the media by toner drum assembly 34 (FIG. 2) and bonded to the media by the exemplary fusing device 48. Accordingly, the temperature of the exemplary fusing device 48 may be high enough to allow for the toner particles to melt and adhere to the media, yet not so high as to damage the media and/or other components of printing device 10. Further, the chemical composition of the developing agent (e.g. toner) may vary the temperature of the fusing device. Additionally, the operating mode of printing device 10 may vary the temperature of the heating (e.g. fusing) device. For instance, the exemplary fusing device 48 may be maintained at 100° Celsius during "Sleep Mode" (e.g., after printing device 10 is idle for ten minutes). In addition, device 48 may be maintained at 150° Celsius during "Standby Mode" (e.g., when printing device 10 is idle for less than ten minutes). Furthermore, fusing device 48 may be maintained at 200° Celsius during "Use Mode" (i.e., when printing device 10 is bonding developing agent to media).

In the event that the temperature of the exemplary fusing device 48 (as monitored by temperature monitoring device 116 and determined by control circuit 100) is above a possible setpoint (e.g., 100° Celsius, 150° Celsius, or 200° Celsius, for example) specified for a possible operating mode (e.g., "Sleep Mode", "Standby Mode", or "Use Mode", respectively), control circuit 100 may provide a gate pulse signal 104 to switching device 102 that prevents power signal 108 from being provided to fusing device 48. This, in turn, may result in a decrease in the temperature of fusing device 48.

Alternatively, if the temperature of the exemplary fusing device 48 is below the setpoint specified for the desired operating mode, control circuit 100 may provide a gate pulse signal 104 to switching device 102 that allows power signal 108 to be applied to fusing device 48. This, in turn, may result in an increase in the temperature of fusing device 48.

Controller 50 may include switching device 122. Such device may be a bimetallic switching device which may therefore include a bimetallic element 124, which may be thermally coupled to exemplary fusing device 48. Bimetallic element 124 may be an electromechanical thermal sensor that is designed to deform in response to variations in the temperature of exemplary fusing device 48. For example, during normal operation of exemplary fusing device 48 (e.g., under 250° Celsius, for example), bimetallic element 124 may be maintained in a first form (e.g., the curved form of bimetallic element 124). However, in the event that exemplary fusing device 48 meets or exceeds e.g., 250° Celsius, bimetallic element 124 may be deformed (e.g., into the form of bimetallic element 124'). Further, once the temperature of exemplary fusing device 48 cools to e.g., below 250° Celsius, deformed bimetallic element 124' may revert back to the original non-deformed shape of bimetallic element 124. Accordingly, bimetallic switching device 122 is resettable, in that bimetallic element 124 may react to an over temperature condition and, subsequently reset itself once the over temperature condition has ended.

Bimetallic element 124 may be constructed of two dissimilar metals (e.g., brass and Invar) that are bonded together. As these dissimilar metals expand at different rates as they warm, bimetallic element 124 may be deformed, cause element 124 to e.g., twist, curve, or cup. For example, if the metal on the concave surface of bimetallic element 124 is constructed of a metal that thermally-expands at a greater rate than the metal on the convex surface of bimetallic element 124, when bimetallic element 124 is warmed, the normally curved shape of bimetallic element 124 may be flattened out (e.g., into the flatter shape of deformed bimetallic element 124').

Bimetallic switching device 122 may include two or more contacts 126, 128 positioned within bimetallic switching device 122. Contacts 126, 128 may be positioned so that, in the event that the temperature of exemplary fusing device 48 increases to beyond the normal operating range of exemplary fusing device 48 (e.g., 250° Celsius or greater) and bimetallic element 124 is deformed (i.e., into deformed bimetallic element 124'), an electrical connection between contact 126 and contact 128 may be established via deformed bimetal element 124'. Accordingly, when bimetallic switching device 122 is wired in parallel with exemplary fusing device 48 (as shown in FIG. 3), in the event of an over temperature condition, an electrical connection between contact 126 and contact 128 may be established by deformed bimetallic element 124'. As bimetallic switching device 122 would typically have a lower resistance value than fusing device 48 (which typically has a resistance of a few ohms), a short circuit condition may be established between conductor 130 and ground 132. This, in turn, would result in an over-current condition within conductor 130. Conductor 130 may include a fusible link/fuse 134 that, in the event of such an over-current condition, fails. As the failure of fusible link/fuse 134 results in power signal 108 no longer being provided to fusing device 48, fusing device 48 may begin to cool and the over temperature condition may be eliminated.

Bimetallic element 124 may be configured and selectively positioned such that bimetallic element 124 assumes the temperature of exemplary fusing device 48 within a defined period of time. For example, the defined period of time may be less than or equal to any time between about 0.1-10.0 seconds and/or any interval of time contained therein. Accordingly, as bimetallic element 124 may track the temperature of exemplary fusing device 48, in the event of an over temperature condition (e.g., exemplary fusing device 48 meeting or exceeding 250° Celsius), bimetallic element 124 may deform, resulting in fusible link/fuse 134 failing, and the over temperature condition being eliminated (as exemplary fusing device 48 is deenergized).

Switching device 122 may also be efficiently thermally coupled to exemplary fusing device 48, wherein efficiently thermally coupling allows for switching device 122 to respond to an over temperature condition prior to damaging fusing device 48 (e.g., prior to causing a heating slab within the fuser device to crack). Switching device 122 may also be efficiently thermally coupled to a heating device such that more thermal energy may be transferred from the heating device to the switching device by conductive heating rather than by convective heating.

Furthermore, the thermal conductivity coefficients (in watts per meter-Kelvin) for certain materials are as follows: diamond 1000-2600; silver 406; copper 385; gold 320; aluminum 205; brass 109; platinum 70; steel 50.2; lead 34.7; mercury 8.3; quartz 8; glass 0.8; Wood 0.04-0.12; wool 0.05; fiberglass 0.04; expanded polystyrene 0.03; HDPE 0.29-0.5; polypropylene 0.1-0.13; molded polystyrene 0.12-0.193; polycarbonate 0.19-0.21 and air (@300 K, 100 kPa) 0.026. Accordingly, to allow switching device 122 and/or bimetallic element 124 to assume the temperature of exemplary fusing device 48 within a defined period of time, it may be desirable to also construct element 138 and or pin 136 of the switching device from a material having a thermal conductivity coefficient greater than about 1.0 W/mK (e.g., copper), as opposed to a material having a relatively low thermal conductivity coefficient (e.g., wood).

For example, when coupling bimetallic element 124 to exemplary fusing device 48, pin 136 (which positions bimetallic element 124 proximate contacts 126, 128) may be sourced from materials with a thermal conductivity greater than about 1.0 watt per meter/Kelvin which pin may be in direct contact with exemplary fusing device 48. Alternatively, when coupling bimetallic element 124 to exemplary fusing device 48, pin 136 may be attached to one or more thermally conductive elements (e.g., element 138; shown in phantom) which elements may also utilize materials with thermal conductivities greater than 1.0 watts per meter/Kelvin.

Element 138 may therefore be attached to exemplary fusing element 48 and pin 136 to provide primarily conductive heating to bimetallic element 124. In addition, element 138 may be constructed of a material having a thermal conductivity coefficient sufficient to allow bimetallic element 124 to assume the temperature of exemplary fusing device 48 within a defined period of time (e.g., less than or equal to about 10 seconds).

While deformed bimetallic element 124' is described above as a current carrying device (i.e., current passes from contact 126 to contact 128 via deformed bimetallic element 124'), other configurations are possible. For example, an alternative exemplary bimetallic switching device 122' may include a pair of contacts 150, 152 with a conductor 154 for forming a conductive path between contacts 150, 152. Pin 156 may position bimetallic element 158 within bimetallic switching device 122'. When cool (i.e., within the normal operating range of fusing device 48), bimetallic element 158 may be positioned as shown. However, during an over temperature condition, bimetallic element 158 may curve (into the position of deformed bimetallic element 158'). As linkage assembly 160 may couple bimetallic element 158 and conductor 154, when bimetallic element 158 moves to the left and into the position of deformed bimetallic element 158', conductor 154 may also move into the position of actuated conductor 154', resulting in an electrical connection being established between contact 150 and contact 152. Accordingly, the current flowing through bimetallic switching device 122' may flow through actuated conductor 154' and may not flow through deformed bimetallic element 158'.

While bimetallic element 124 is described above as being connected to exemplary fusing device 48 with pin 136, other configurations are possible. For example, bimetallic element 180 may be positioned so that a portion of bimetallic element 180 physically contacts fusing device 48. Further, contacts 182, 184 may be solder mounds on the surface of fusing device 48. Additionally, pin 186 may be configured to maintain contact between bimetallic element 180 and fusing device 48, thus allowing for conductive heat transfer between device 48 and element 180. During an over temperature condition, bimetallic element 180 may deform (into the position of deformed bimetallic element 180'), thus electrically coupling contacts 182, 184. Accordingly, pin 186 may therefore be made of a material having a thermal conductivity of less than 1.0 watt per meter-Kelvin (e.g., plastic), and may be contained within a plastic housing 188.

While FIG. 3 illustrates bimetallic switching device 122 being electrically coupled in parallel with fusing device 48, other configurations are possible. For example and referring also to FIG. 4, bimetallic switching device 200 may be electrically coupled in series with fusing device 48.

Unlike bimetallic switching device 122 (FIG. 3), which is a normally open switching device (i.e., a device that normally does not conduct electricity), bimetallic switching device 200 may be a normally closed switching device (i.e., a device that normally conducts electricity. Bimetallic switching device 200 may include two or more contacts 202, 204 positioned within bimetallic switching device 200. Contacts 202, 204 may be positioned so that, in the event of the temperature of exemplary fusing device 48 increasing to beyond the normal operating range of exemplary fusing device 48 (e.g., 250° Celsius or greater), bimetallic element 206 may be deformed (i.e., into deformed bimetallic element 206'), interrupting the electrical connection between contacts 202 and 204.

Figure 4:
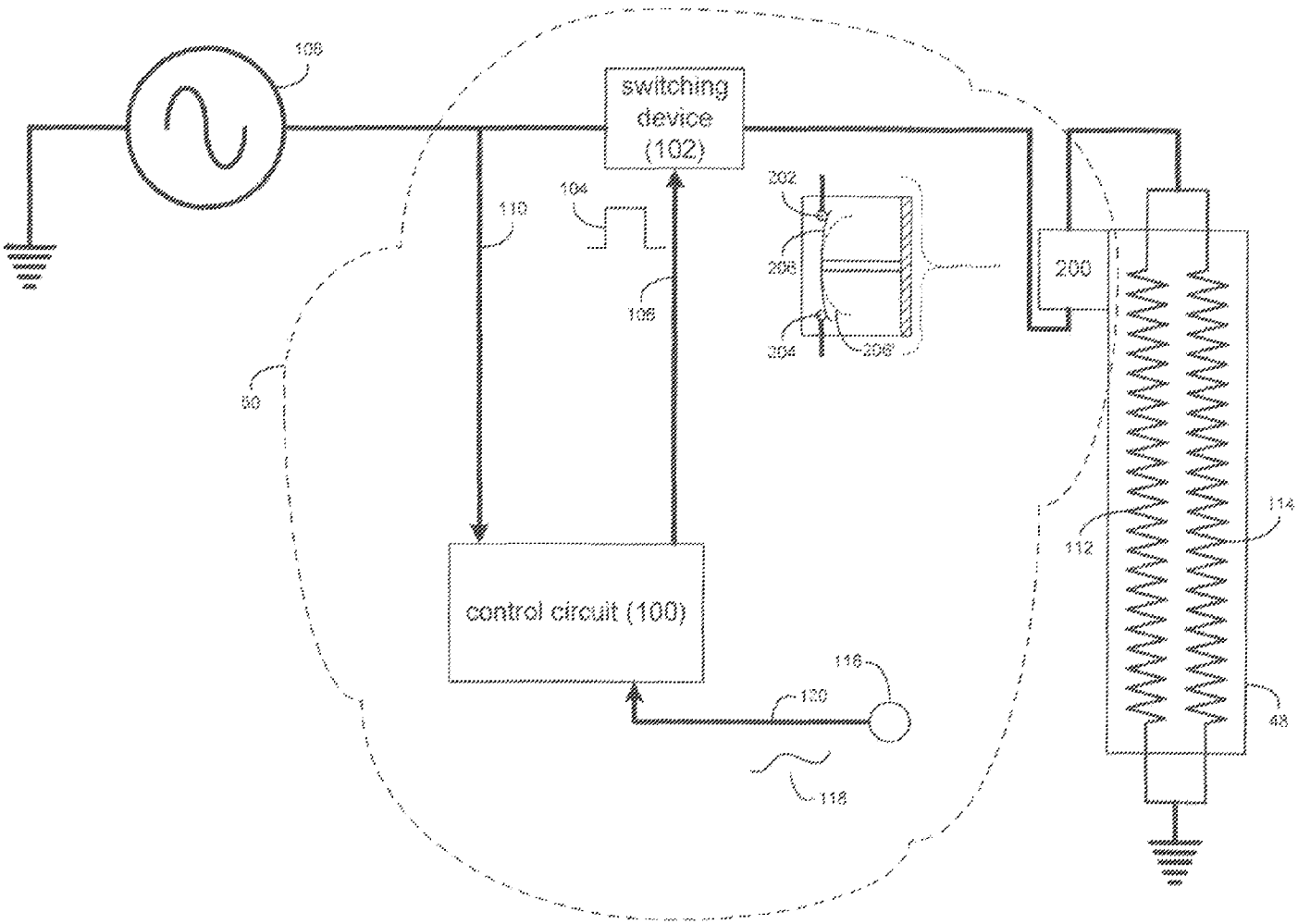
FIG. 4 is a diagrammatic view of the controller of FIG. 2, including a second exemplary implementation of a bimetallic switching device.

As, in the series connection shown in FIG. 4, power signal 108 may be provided to exemplary fusing device 48 through bimetallic switching device 200, if an over temperature condition occurs and the electrical connection between contact 202 and contact 204 is interrupted, power signal 108 may no longer be provided to exemplary fusing device 48. Accordingly, exemplary fusing device 48 may begin to cool and the over temperature condition may be eliminated. As discussed above, bimetallic switching device 200 may be configured so that bimetallic element 206 is not a current carrying device through the use of a conductor 154 (FIG. 3) and a linkage assembly 160 (FIG. 3).

Figure 5:
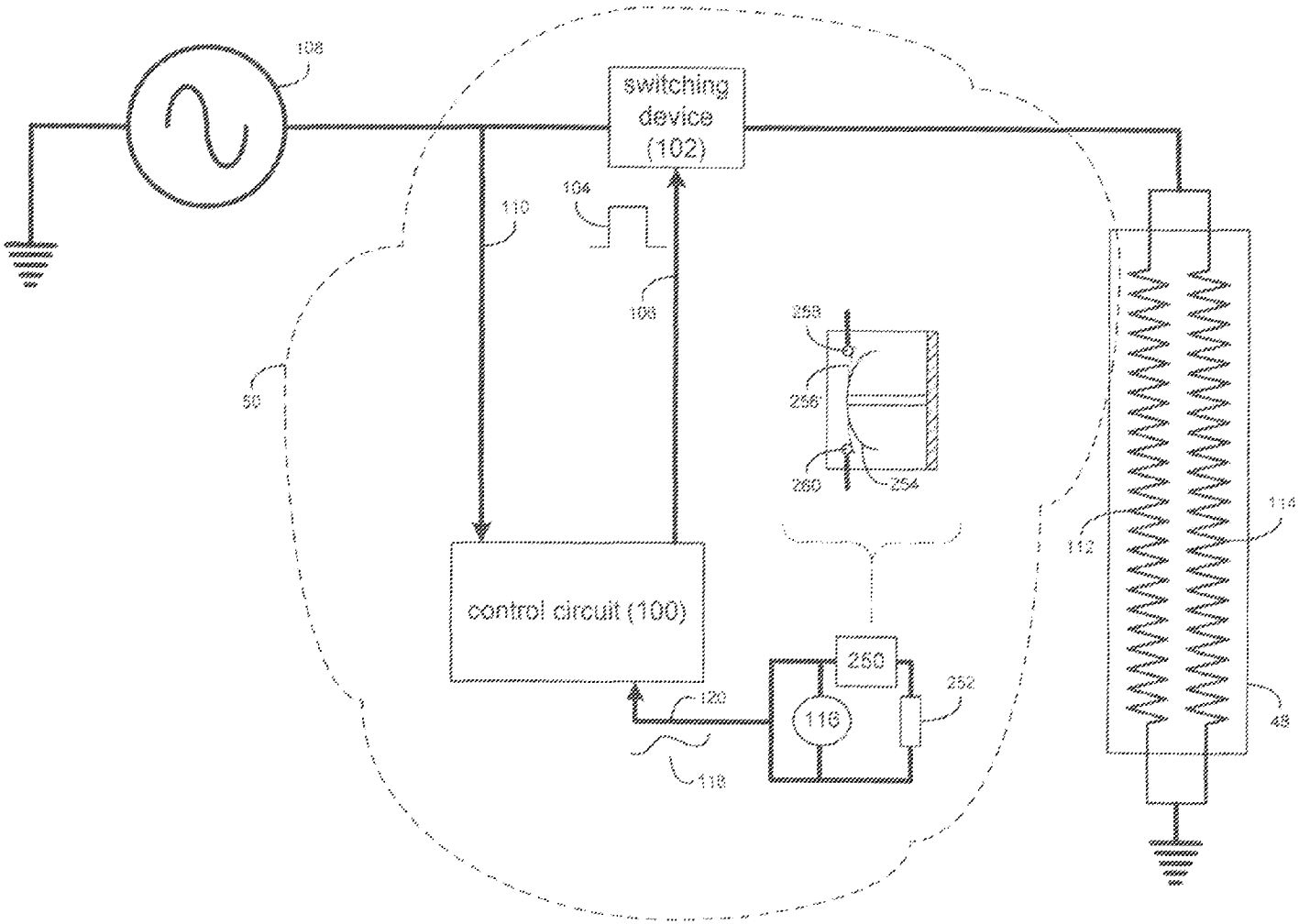
FIG. 5 is a diagrammatic view of the controller of FIG. 2, including a third exemplary implementation of a bimetallic switching device.

While bimetallic switching device 122 (FIG. 3) and bimetallic switch 200 (FIG. 4) are described above as directly deenergizing exemplary fusing device 48 (i.e., either through bimetallic switch 122 shorting power signal 108 or bimetallic switch 200 opening power signal 108), other configurations are possible. For example and referring also to FIG. 5, bimetallic switch device 250 may be configured to vary the temperature sensed by control circuit 100. As discussed above, temperature monitoring device 116 (e.g., a thermistor) may provide a temperature signal 118 to control circuit 100 via conductor 120. A thermistor is typically a solid-state, temperature-dependant resistance device. Accordingly, by monitoring the resistance of temperature monitoring device 116, the temperature of the exemplary fusing device 48 may be determined by control circuit 100.

One may therefore assume that temperature monitoring device 116 has a resistance of 2,500 Ohms @ 250° Celsius. Further, assume that this resistance decreases as temperature increases. Accordingly, bimetallic switching device 250 may be positioned in series with resistive device 252, such that the combination of bimetallic switching device 250 and resistive device 252 are in parallel with temperature monitoring device 116. Resistive device 252 may be sized so that the parallel resistance of temperature sensing device 116 and resistive device 252 may result in a combined parallel resistance that is low enough to trigger an over temperature event within control circuit 100. Accordingly, control circuit 100 may then provide a signal to switching device 102 that deenergizes exemplary fusing device 48. For example, assume that resistive device 252 is 2,500 ohms (i.e., the same resistance as temperature monitoring device 116 at 250° Celsius). Accordingly, in the event of an over temperature condition, bimetallic element 254 will deform (i.e., into deformed bimetallic element 256') and electrically connect contacts 258, 260. This may result in resistive device 252 being in a parallel configuration with temperature monitoring device 116. As each device has a resistance of 2,500 ohms, the resulting parallel resistance seen by control circuit 100 may be (2,500×2,500)/(2,500+2,500) or 1,250 ohms. As discussed above, as temperature monitoring device 116 may be configured to decrease in resistance as temperature is increased, control circuit 100 may interpret a 1,250 ohm reading as an over temperature condition. Accordingly, switching device 102 may be opened and exemplary fusing device 48 may be deenergized.

While control circuit 100 is described above as being a stand-alone circuit, other configurations are possible. For example, the functionality of control circuit 100 may be implemented via one or more processes (not shown) executed by e.g., microprocessor 16. The instruction sets and subroutines of these processes (not shown) may be stored on a storage device (e.g., ROM 20) and executed by microprocessor 16 using RAM 18. Other examples of the storage device may include a hard disk drive or an optical drive, for example.

While the heating device being controlled by control circuit 100 is described above as a fusing device, other configurations are possible. For example, control circuit 100 may control the temperature of a heating device used to dry ink within an inkjet printer.

A number of implementations have been described. Nevertheless, it will be understood that various modifications may be made. Accordingly, other implementations are within the scope of the following claims.

The invention claimed is:

1. A heating assembly for a printing device comprising:

a heating device configured to be energized or deenergized including a thermally conductive element in contact with said heating device; and a switching device including a bimetallic element efficiently thermally coupled to the thermally conductive element wherein said thermally conductive element has a thermal conductivity coefficient such that said thermally conductive element assumes the temperature of said heating device within ten seconds and said switching device deenergizes the heating device in a defined period of time in the event of an over temperature condition, wherein said switching device is electrically coupled in series with the heating device wherein when said switching device is closed said heating device is energized and when switching device is open said heating device is deenergized.

2. The heating assembly of claim 1 including a connector between the switching device and the heating device, wherein the connector has a thermal conductivity of at least 1.0 watt per meter-Kelvin.

3. The heating assembly of claim 1 wherein the heating device is a ceramic resistive heating device.

4. The heating assembly of claim 1 wherein the heating device is a metallic resistive heating device.

5. The heating assembly of claim 1 wherein the heating device is an ink drying assembly configured for drying ink on media.

6. The heating assembly of claim 1 wherein the heating device is a fusing device configured for bonding toner to media.

7. A bimetallic switching device for a heating device in a printer comprising:

a bimetallic element coupled to the heating device wherein the heating device includes a thermally conductive element;

wherein the bimetallic element is efficiently thermally coupled to the thermally conductive element of the heating device and wherein said thermally conductive element has a thermal conductivity coefficient such that said thermally conductive element assumes the temperature of said heating device within ten seconds and said bimetallic element deenergizes the heating device in the event of an over temperature condition, and said bimetallic element is in series to the heating device in said energized state.

8. The switching device of claim 7 including a connector between the switching device and the heating device, wherein the connector has a thermal conductivity of at least 1.0 watt per meter-Kelvin.

9. The switching device of claim 7 wherein the heating device is a ceramic resistive heating device.

10. The switching device of claim 7 wherein the heating device is a metallic resistive heating device.

11. The switching device of claim 7 wherein the heating device is an ink drying assembly configured for drying ink on media.

12. The switching device of claim 7 wherein the heating device is a fusing device configured for bonding toner to media.

13. A switching device for a printer comprising:

a resettable element including a thermally conductive element wherein said thermally conductive element has a thermal conductivity coefficient such that that said thermally conductive element assumes the temperature of a heating device within ten seconds;

said switching device containing said resettable element positioned in series with a resistive device wherein the combination of said switching device and said resistive device is positioned in parallel with a temperature monitoring device wherein the parallel resistance of said temperature monitoring device and resistive device is configured to provide a combined parallel resistance to trigger an over temperature condition and deenergize said heating device.

14. The switching device of claim 13 wherein said temperature monitoring device comprises a thermistor.

15. The switching device of claim 13 wherein the heating device is a ceramic resistive heating device.

16. The switching device of claim 13 wherein the heating device is a metallic resistive heating device.

17. The switching device of claim 13 wherein the heating device is an ink drying assembly configured for drying ink on media.

18. The switching device of claim 13 wherein the heating device is a fusing device configured for bonding toner to media.

* * * * *